US011225407B2

(12) United States Patent
Tobias, III

(10) Patent No.: US 11,225,407 B2
(45) Date of Patent: Jan. 18, 2022

(54) COMFORT BRIDGE FOR AN ENGLISH SADDLE

(71) Applicant: Frank Tobias, III, Palm Beach Gardens, FL (US)

(72) Inventor: Frank Tobias, III, Palm Beach Gardens, FL (US)

( * ) Notice: Subject to any disclaimer, the term of this patent is extended or adjusted under 35 U.S.C. 154(b) by 45 days.

(21) Appl. No.: 16/787,587

(22) Filed: Feb. 11, 2020

(65) Prior Publication Data

US 2020/0255283 A1 Aug. 13, 2020

Related U.S. Application Data

(60) Provisional application No. 62/804,477, filed on Feb. 12, 2019.

(51) Int. Cl.
*B68C 1/02* (2006.01)
*B68C 1/04* (2006.01)

(52) U.S. Cl.
CPC ..... *B68C 1/025* (2013.01); *B68C 1/04* (2013.01); *B68C 2001/042* (2013.01)

(58) Field of Classification Search
CPC .. B68C 1/025; B68C 1/10; B68C 1/04; B68C 1/14
See application file for complete search history.

(56) References Cited

U.S. PATENT DOCUMENTS

| | | | | |
|---|---|---|---|---|
| 9,315,374 | B2 | 4/2016 | Merlin et al. | |
| 2004/0065062 | A1 | 4/2004 | Harrison | |
| 2013/0291496 | A1 | 11/2013 | Vergara | |
| 2016/0145092 | A1* | 5/2016 | Marchetto | B68C 1/02 |
| 2017/0183216 | A1* | 6/2017 | Kaden | B68C 1/04 |

* cited by examiner

*Primary Examiner* — Joshua J Michener
*Assistant Examiner* — Henry Hooper Mudd
(74) *Attorney, Agent, or Firm* — McHale & Slavin, P.A.

(57) ABSTRACT

A comfort bridge for use with an English saddle. The bridge is formed of sole bend leather of a particular size, shape, and thickness positioned between a tree point and the back of the saddle tree. The bridge is placed on each side of the saddle and either placed within a panel or attached thereto. The bridge increases the structural support area by carrying the rider's weight over a larger area under the rider's leg. Each bridge is tapered around the edges to provide a smooth connection to the saddle panel, and provide for the comfort of the rider by avoiding the large material stuffing mass that has been traditionally used in the saddle panels of early designs.

8 Claims, 7 Drawing Sheets

COMFORT BRIDGE FOR AN ENGLISH SADDLE

REFERENCE TO RELATED APPLICATIONS

This application claims the benefit and priority date of U.S. Provisional Patent Application No. 62/804,477, filed Feb. 12, 2019, entitled "COMFORT BRIDGE FOR AN ENGLISH SADDLE" the contents of which are hereby expressly incorporated by reference.

FIELD OF THE INVENTION

This invention is directed to the equine field and, in particular, to a bridge panel for use on an English saddle.

BACKGROUND OF THE INVENTION

A saddle tree is used to distribute the weight of a rider over a horse's back, making it comfortable for both the rider and the horse. A saddle tree consists of two parallel positioned rails, a fork that holds the rails together at the front end, and a cantle that holds the rails together at the rear end. Traditionally, a leather panel filled with stuffing mass, usually wool "flocking," or a foam insert, is placed under each side of the saddle tree where it makes contact with the horse's back.

Traditional English saddle trees are designed to carry the rider's weight over a large area of the horse's back, i.e. over the longissimus muscle. The longissimus muscle is the major back muscle on a horse, running from the pelvis to the cervical vertebra. Since a saddle sits on this muscle, proper design of the saddle is critical. A poorly fitting saddle is painful and restrictive to the horse. A well-fitting saddle provides comfort to the horse, allowing movement through the shoulder, back, rib cage, loin and hindquarters. For example, a tunnel beneath the fork of a saddle is known as the gullet. If the gullet height is too short, the saddle will rub on the horse's dorsal spine, known as the withers. If the gullet width is too wide, the saddle will sit too low on the shoulders and rub the horse's withers, which is most uncomfortable to the horse. Proper saddle design is not limited to providing comfort to the horse; a saddle design must also provide comfort to the rider.

In a conventional saddle, the rider's weight is carried on tree points at the front of the saddle and under the back of the saddle tree, having an hourglass shape. This creates a narrower "twist" for the rider; meaning the rider's leg can fall straight down into place, putting the rider's weight more forward in the saddle. Riders do not want to feel a wide "twist" that creates bulk under their leg, preventing the proper riding position by keeping the lower leg of the rider away from the horse. However, due to the hourglass shape, the area of the tree under the rider's leg provides no support for the weight of the rider.

The horse's back is more comfortable when the rider's weight is carried forward and over a larger surface area, which results in better performance. Unfortunately, this creates a wide twist that riders dislike because it puts the rider behind the motion of the horse, or in the back of the saddle, and causes the horse's lower back to be sore. Conversely, a saddle that is most comfortable and efficient for the rider, with a narrow "twist", narrows the weight bearing surface to the tree points and just under the rider's seat, creating discomfort for the horse, with specific pressure points under the contact points of the saddle.

Saddle makers have been stuffing panels for centuries. Various stuffing includes a range of natural fibers such as horse, sheep or wool hair and manmade fibers made from various acrylics. The stuffing conforms to the shape of the horse but the stuffing requires maintenance to make sure it does not pack down hard or shift. Once packed down hard the stuffing would need to be replaced.

A small pack mule can carry an astounding amount of weight on its back for hours because the pack harness is designed to spread the weight over a very large area of the mule's back. This large, weight bearing surface, however, would be completely intolerable for a proper rider.

Thus, what is lacking in the art is a comfort bridge and method of positioning flocking to properly distribute the weight of a rider on a saddle in a manner most comfortable to both the horse and rider.

PRIOR ART REFERENCES

U.S. Publication 2013/0291496, entitled "Free Shoulder Panel Saddle", discloses a padded "free shoulder" panel with a reduced thickness forward section that is configured to provide a physical barrier between the saddle tree and saddle outer flaps and the horse's scapula, while preventing substantial weight transfer onto the scapula or other deleterious contact with the scapula and horse shoulder area.

U.S. Publication 2004/0065062, entitled "Adjustable Equine Saddle Tree", discloses an adjustable saddle tree for use with the JaHar Saddles® for implementation on equine members in either English or Western styles.

U.S. Pat. No. 9,315,374, entitled "Adjustable Frame for a Riding Saddle That Does Not Require Disassembly" discloses an adjustable frame for a riding saddle that includes a saddle tree arranged on a portion of a riding saddle and having two longitudinal arms and at least one rotatable continuous part passing through the saddle tree.

SUMMARY OF THE INVENTION

The present invention discloses a leather saddle panel that contains a comfort bridge formed of a rigid material positioned between the tree point and the back of the saddle tree, forming a wedge-shaped panel. The bridge increases the structural support area by carrying the rider's weight over a larger area under the rider's leg. The comfort bridge allows comfort for the horse by spreading the rider's weight across a larger area, avoiding the "pressure points" behind the horse's shoulder typically caused by the tree points. The bridge also provides comfort for the rider by reducing the size of the material stuffing mass, or "flocking", directly under the rider's leg that is created in the saddle panels of early designs. The inverted teardrop shape of the invention provides a seamless close connection between the rider's leg and the horse.

An objective of the invention is to provide a comfort bridge constructed and arranged to provide better distribution of a rider's weight on a saddle.

Still another objective of the invention is to provide a comfort bridge that reduces the mass and large shape of the padded material stuffing mass or "flocking" placed directly under the rider's leg on conventional saddles.

Another objective of the invention is to provide a more comfortable saddle for a horse by spreading the weight of a rider forward and across a larger area to avoid pressure points behind the horse's shoulder.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DESCRIPTION OF THE PREFERRED EMBODIMENT

Figure 1:
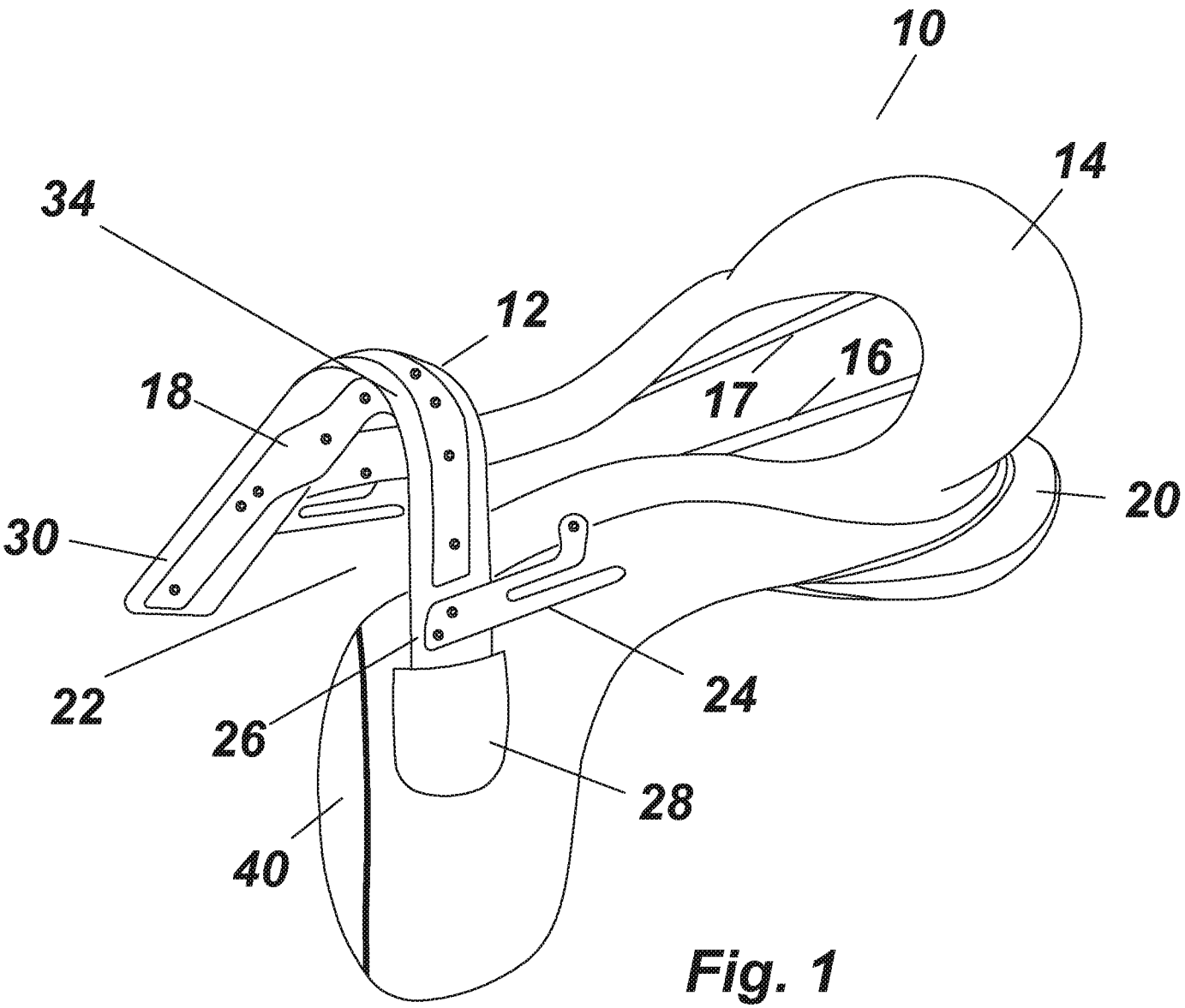
FIG. 1 is a perspective view of a saddle tree.
Figure 2:
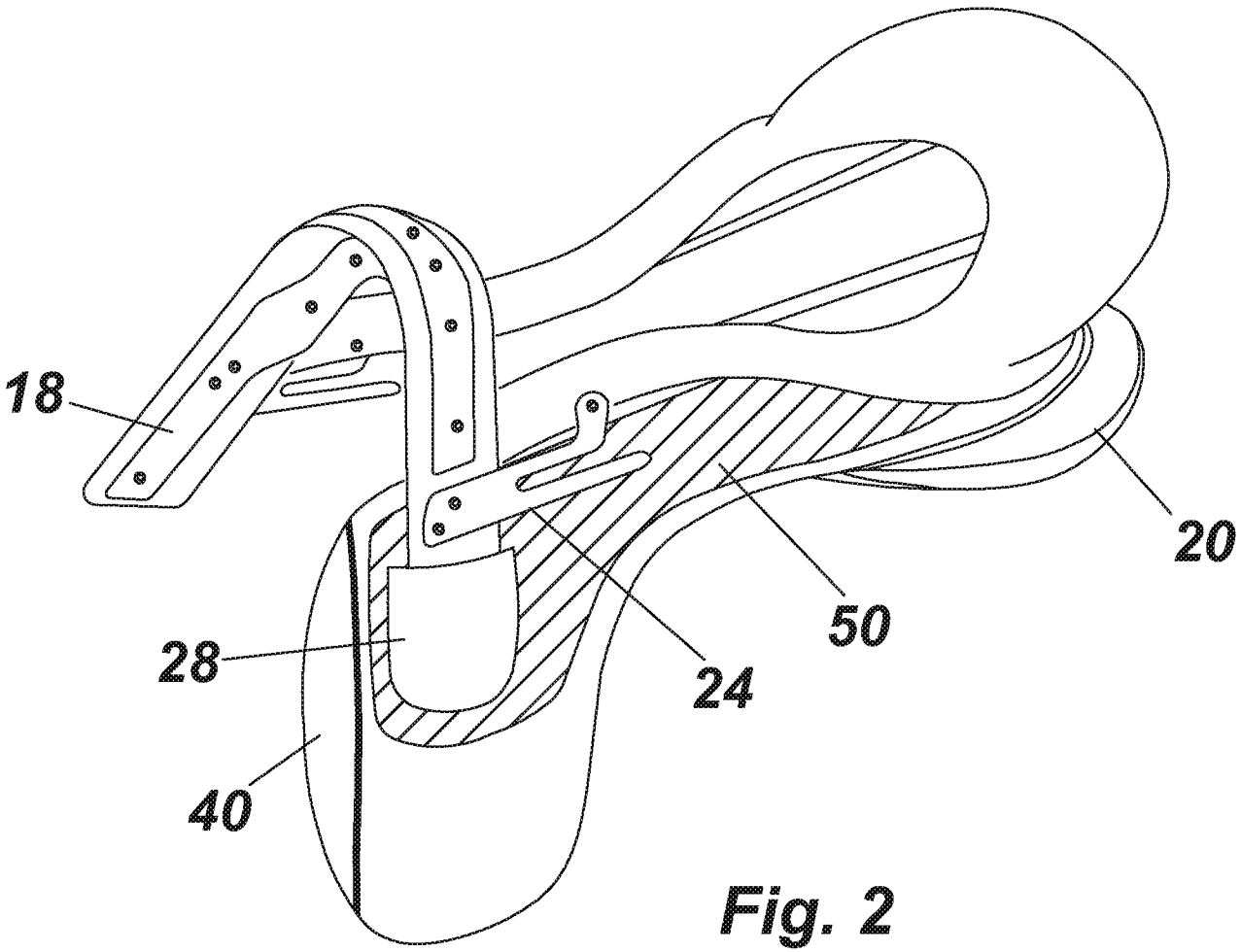
FIG. 2 is a cut-away perspective view of FIG. 1 illustrating the bridge within a pocket.
Figure 3:
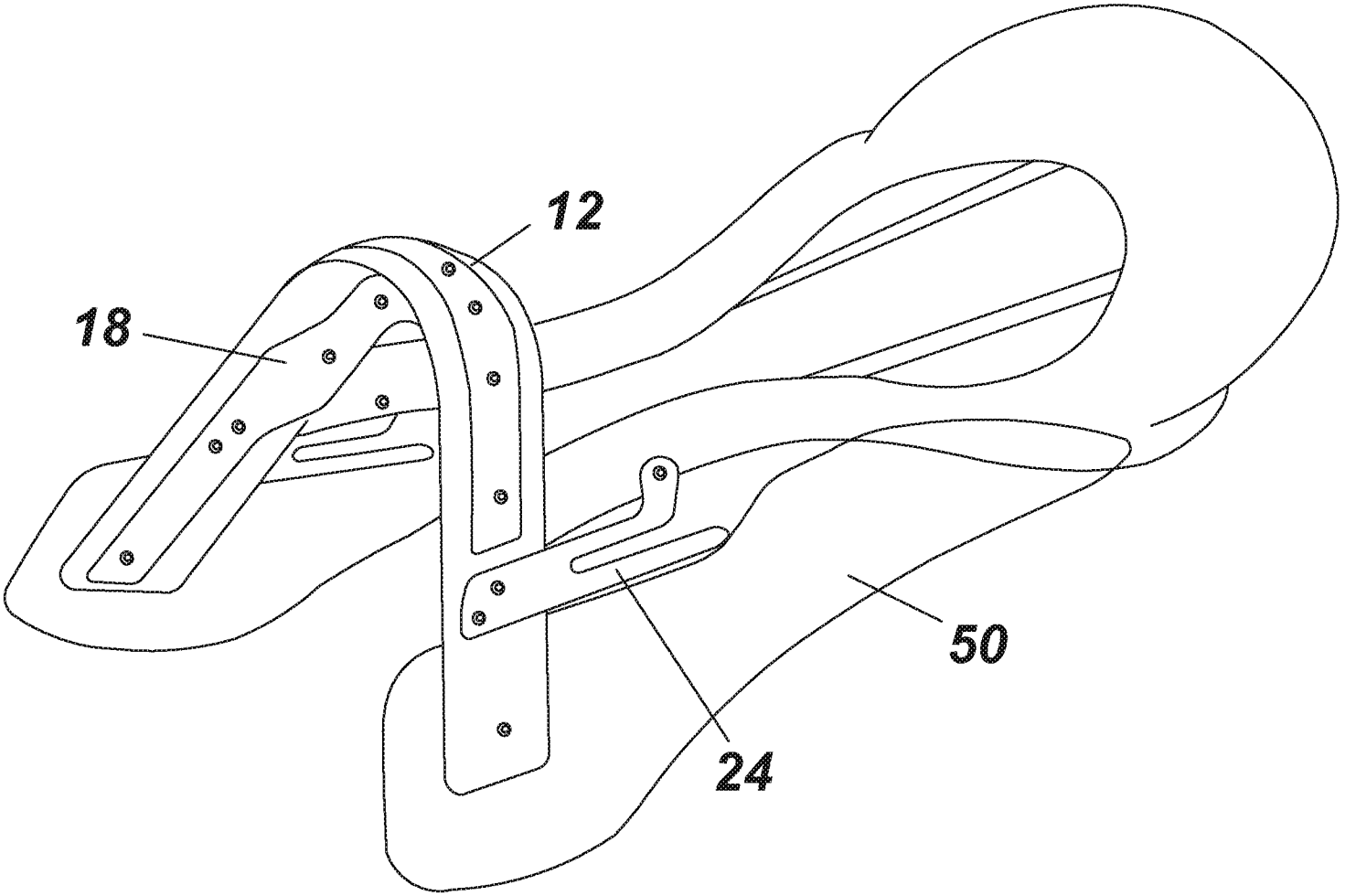
FIG. 3 is a cut-away perspective view of FIG. 1 illustrating the bridge with the tree point and tree rail over the bridge.
Figure 4:
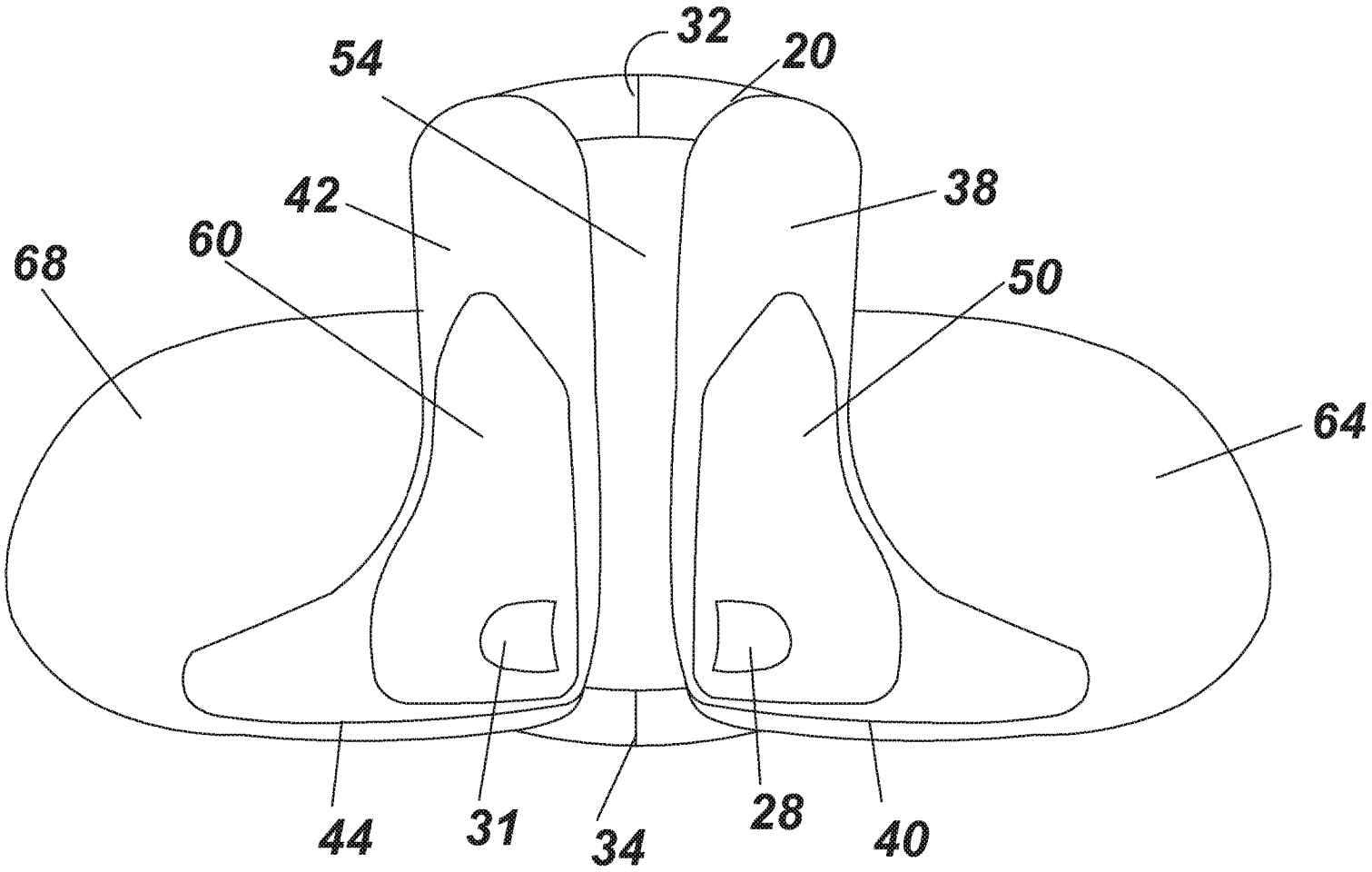
FIG. 4 is a cross sectional top view illustrating the bridge placement.
Figure 5:
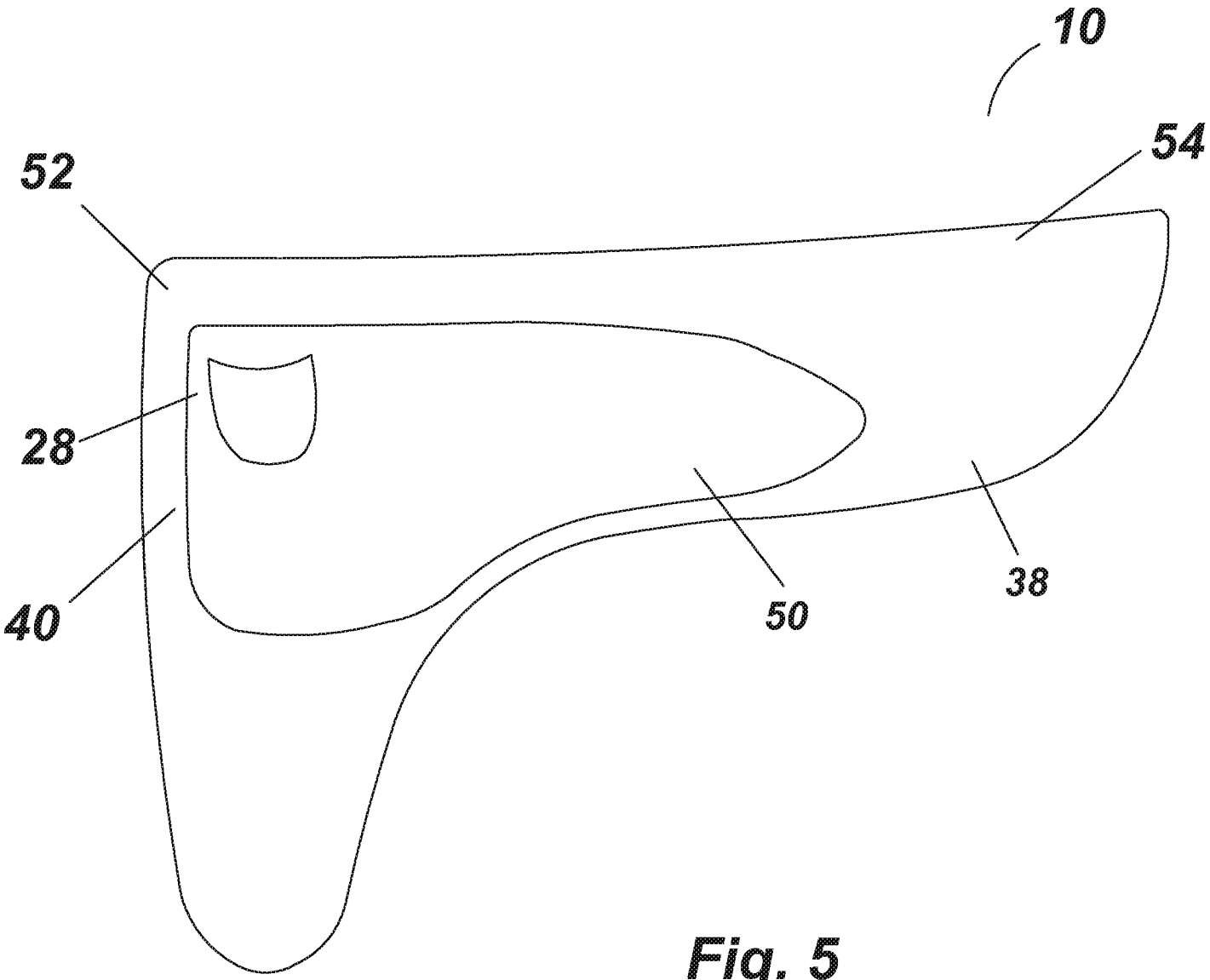
FIG. 5 is a cross sectional side view illustrating the bridge placement.
Figure 6:
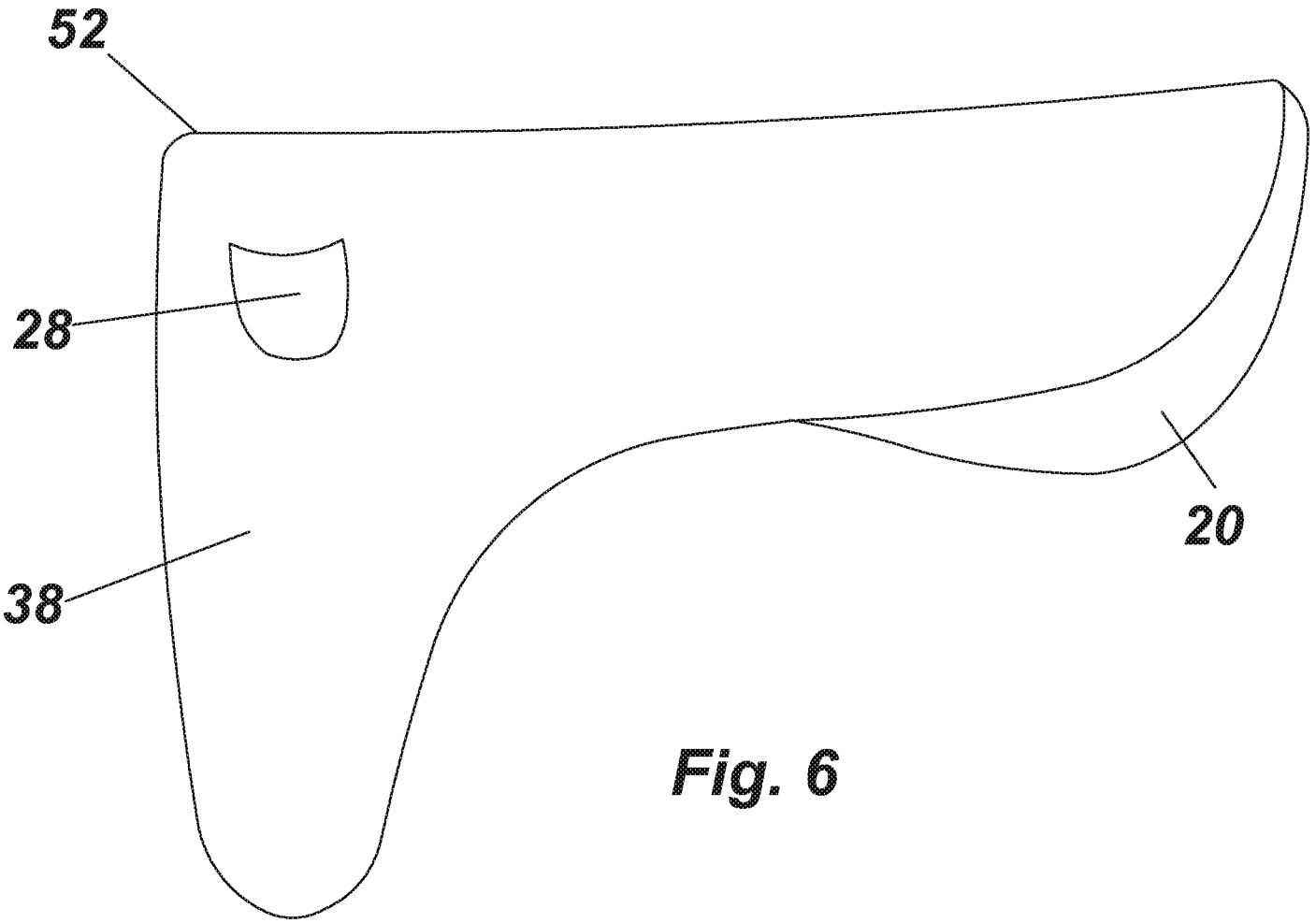
FIG. 6 is a side view illustrating the pocket.

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Referring now to the Figures, set forth is an English saddle tree 10 defined by a head 12 with tree points 26 and 30, and cantle 14. Parallel springs 16 and 17 extend from the gullet plate 18 to the rear cantle 14. This is preferably known as the English spring tree, forming a gullet cavity 22. A stirrup bar 24 is illustrated in securement with the gullet plate 18 and spring 17. A first end, tree point 26, of the gullet plate 18 is held within a first point pocket 28. A second end, tree point 30, of the gullet plate 18 is held within a second point pocket 31. A seat 32, having a front portion referred to as the pommel 34, attaches to the head 12, and a rear portion forms the cantle 14. The saddle 10 forms an adjustable head plate that incorporates a leather, wool-flocked, left side panel 38 that extends between the rear gusset 20 and a left side front gusset 40, and a second, right side panel 42 that extends between the rear gusset 20 and a right side front gusset 44.

The instant invention consists of a first bridge 50, which is a rigid structure positioned under the tree point 52 and continues back under the rear portion 54 of the saddle tree. The first bridge 50 is constructed from sole bend leather having a predetermined rigidity, and is attached to the leather panel on the top side closest to a rider's leg. Similarly, a second bridge 60 is a rigid structure positioned under the tree point 52 and continues back under the rear portion 54 of the saddle tree. The second bridge 60 is also constructed from sole bend leather having a predetermined rigidity, and is attached to the leather panel 42 on the top side closest to a rider's leg. The first and second bridge 50, 60 can be attached on or in the top of the panel, either on the outside or as part of the panel by placement in a cavity that is formed by the panel. The tree point must be over the bridge, and the bridge must be under the tree point to extend to the back of the saddle under the tree rail under the seat of the rider. The bridge must start at the front edge of the tree at a minimum.

The first and second bridge 50, 60 form a mirror image of each other. The sole bend material is more difficult to work with initially; however, over time the sole bend material will conform to shape of the horse. This bridge is preferably 6-8 mm thick, but always less than 10 mm in thickness. The edge of each bridge is beveled to provide a smooth connection to the leather saddle panel under the rider's leg. Each bridge is about 100 mm tall by about 300 mm long. The first bridge 50 is installed in the left panel 38 through the opening along the inside top edge and attaching the bridge to the panel by lacing, stitching, glue or hook and loop attachment. The left panel having a cavity for receipt of the first bridge. Material stuffing mass or "flocking," of either natural or synthetic wool or foam 90 is placed in the cavity to form a wedge shape depicted in FIG. 8. The second bridge 60 is installed in the right panel 42 through the opening along the inside top edge and attaching the bridge to the panel by lacing, stitching, glue or hook and loop attachment. The right panel 42 having a cavity for receipt of the second bridge 60. Material stuffing mass 92 is placed in the cavity to form a wedge shape depicted in FIG. 8. A left side sweat flap 64 is optionally positioned beneath the left side leather panel 38, and a right side sweat flap 68 is optionally positioned beneath the right side leather panel 42.

Figure 7:
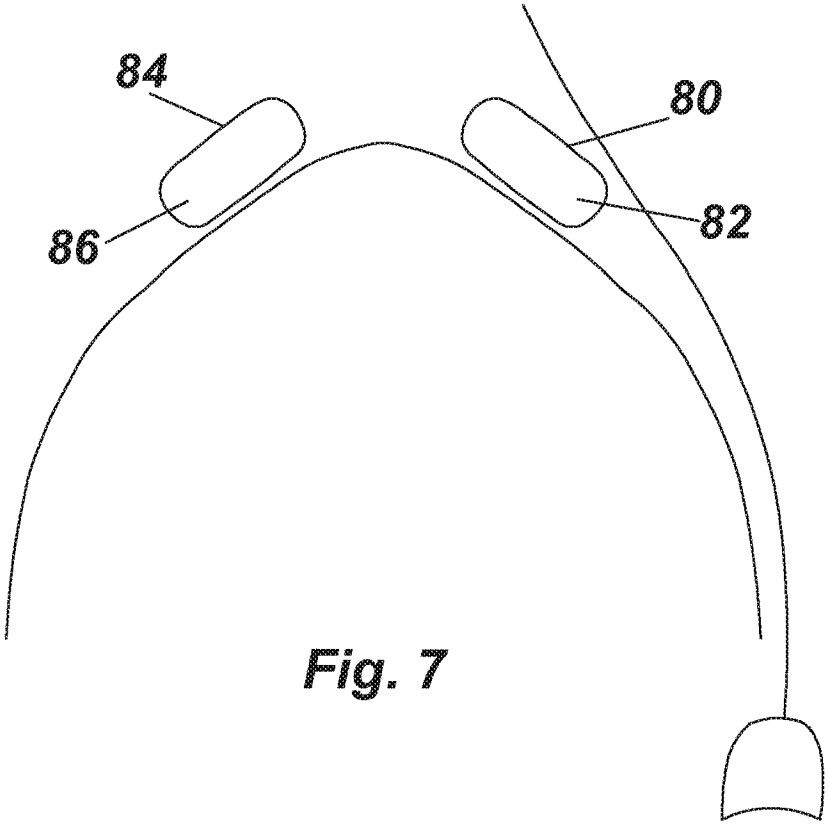
FIG. 7 is a cross sectional end view depicting conventional panel shape with padding.
Figure 8:
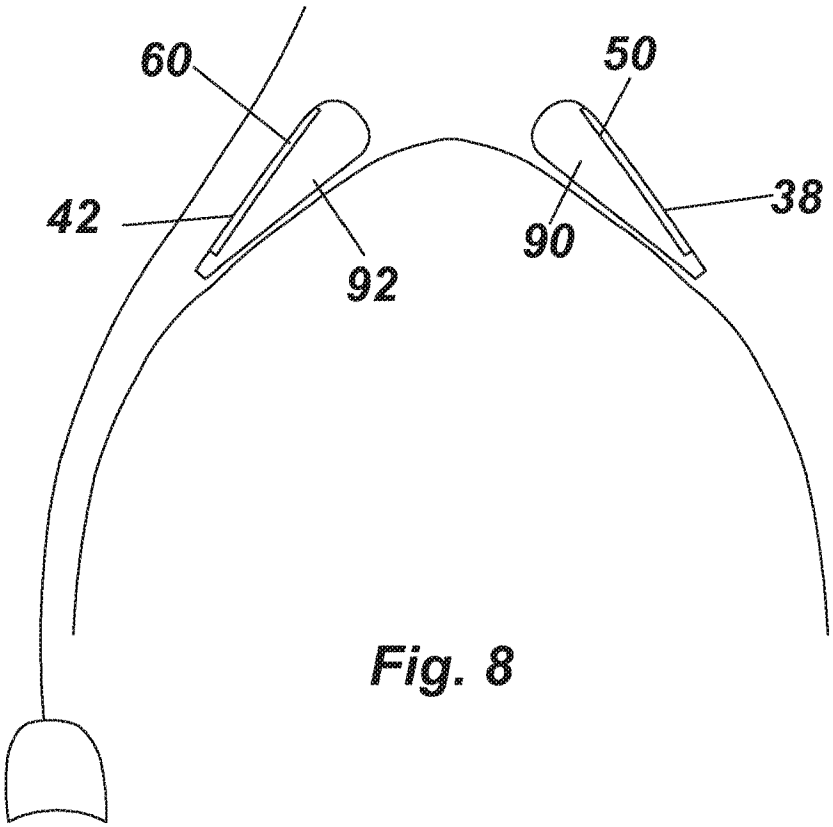
FIG. 8 is a cross sectional end view depicting panel shape with padding for the bridges of the instant invention.

FIG. 7 depicts a conventional leather panel 80 with material stuffing 82. The material stuffing provides comfort to the horse, but causes the rider's leg to be positioned outwardly, which creates an awkward "chair seat" leg position for the rider. Similarly, leather panel 84 with material stuffing 86 causes the rider's leg to be positioned outwardly, which creates the chair seat leg position for the rider. FIG. 8 depicts the first leather panel 38 with the bridge 50 inserted within the panel 38 or attached to the outer surface of the panel closest to the rider's leg, under the tree point. Stuffing material 90 is used around the bridge 50 in a pattern that maintains the rider's leg close to the horse's body. Similarly, the second leather panel 42 with the bridge 60 is inserted within the panel 42. Stuffing material 92 is used around the bridge 60.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The term "coupled" is defined as connected, although not necessarily directly, and not necessarily mechanically. The use of the term "or" in the claims is used to mean "and/or" unless explicitly indicated to refer to alternatives only or the alternative are mutually exclusive, although the disclosure supports a definition that refers to only alternatives and "and/or." The term "about" means, in general, the stated value plus or minus 5%.

What is claimed is:

1. An improvement for an English horse saddle having first and second panels extending along each side of a saddle seat, said improvement comprising:

a first bridge formed from sole bend leather for insertion in said first panel, said first bridge having a length extending from a front edge of a horse saddle tree point to a back portion of the saddle under a tree rail located beneath said saddle seat;

first material stuffing inserted in said first panel positioned alongside said first bridge forming a wedge shape;

a second bridge formed from sole bend leather for insertion in said second panel, said second bridge having a length extending from a front edge of the horse saddle tree point to a back portion of the saddle under the tree rail beneath said saddle seat;

second material stuffing inserted in said second panel positioned alongside said second bridge forming a wedge shape;

wherein said first and second bridges with material stuffing are constructed and arranged to distribute the weight of a rider seated on said saddle across a length of each said bridge.

2. The improvement according to claim 1 wherein said first and second bridge are constructed and arranged to conform to the torso of a horse.

3. The improvement according to claim 1 wherein said sole bend leather has a thickness of about 6-8 mm.

4. The improvement according to claim 3 wherein said first and second bridge conform to the torso of an individual horse when the sole bend leather is subjected to heat and moisture allowing the sole bend leather to harden to the shape of the horse.

5. The improvement according to claim 1 wherein said first bridge is a mirror image of said second bridge.

6. The improvement according to claim 1 wherein each said bridge includes a beveled edge to provide a smooth connection to the saddle under the rider's leg.

7. The improvement according to claim 1 wherein each said bridge has a length of about 300 mm.

8. The improvement according to claim 1 wherein each said bridge is attached to each said panel by lacing, stitching, glue or hook and loop attachment.

* * * * *